United States Patent [19]

Abrams et al.

[11] Patent Number: 4,732,015

[45] Date of Patent: Mar. 22, 1988

[54] KNITTED ARTICLE

[75] Inventors: Walter W. Abrams, Conover; Roger D. Good, Hickory, both of N.C.

[73] Assignee: American Doubloon Corporation, Hickory, N.C.

[21] Appl. No.: 790,443

[22] Filed: Oct. 23, 1985

[51] Int. Cl.[4] ..... D04B 9/46; D04B 9/56

[52] U.S. Cl. ..... 66/172 E; 66/182; 66/185

[58] Field of Search ..... 66/172 E, 182, 184, 66/185, 186, 187, 191, 194

[56] References Cited

U.S. PATENT DOCUMENTS

| | | | |
|---|---|---|---|
| 1,790,832 | 2/1931 | O'Lena | 66/194 X |
| 2,102,369 | 12/1937 | Martel | 66/172 E |
| 2,144,563 | 1/1939 | Davis | 66/182 |
| 2,220,803 | 11/1940 | Lesher | 66/172 E |
| 2,379,852 | 7/1945 | Nebel | 66/194 |
| 2,715,824 | 8/1955 | Krauss et al. | 66/194 X |
| 3,793,851 | 2/1974 | Thorneburg | 66/185 |
| 4,104,892 | 8/1978 | Thorneburg | 66/185 |
| 4,194,249 | 3/1980 | Thorneburg | 66/182 X |
| 4,253,317 | 3/1981 | Howard et al. | 66/186 |
| 4,255,949 | 3/1981 | Thorneburg | 66/185 |
| 4,277,959 | 7/1981 | Thorneburg | 66/182 |

FOREIGN PATENT DOCUMENTS 62969 10/1982 European Pat. Off. .

*Primary Examiner*—Wm. Carter Reynolds

*Attorney, Agent, or Firm*—Shefte, Pinckney & Sawyer

[57] ABSTRACT

A knitted athletic sock having a double terry cushion area having two sets of terry pile loops of differing sizes and shapes and staggered walewise with respect to one another to provide upstanding support and resist flattening of the terry loops for improved cushioning and moisture absorption. The sock preferably is of a terry construction throughout the entire foot except for a single jersey panel in the front ankle region to resist wrinkling and bunching of the sock in such region when worn. The sock also includes a mock rib elastic cuff having a relatively frequent rib repeat in the front shin area and a relatively infrequent rib repeat in the rear calf area to better accommodate different sizes and shapes of calves while resisting slippage of the cuff and leg portion of the sock along the wearer's leg. The cushion area of the sock is knitted by an improved method on a circular knitting machine by selectively positioning knitting needles at differing yarn receiving positions and feeding the two terry yarns at differing levels for receipt of one terry yarn by all needles and the second terry yarn by only selected needles. The two terry yarns are fed by feed fingers which are stationariy set and left in feeding position throughout the operation of the machine, the first terry yarn being fed to all needles throughout the entire knitting operation and the second terry yarn being automatically cut whenever a successive group of needles is positioned to receive only the first terry yarn, with the last needle receiving the second terry yarn carrying it to a cutting mechanism without requiring manipulation of the feed finger to a non-feeding position, whereby missed stitches of the second yarn are eliminated and faster operation of the machine is possible.

20 Claims, 11 Drawing Figures

KNITTED ARTICLE

BACKGROUND OF THE INVENTION

The present invention relates generally to knitted articles and methods for knitting same, and more particularly, to knitted athletic socks and similar hosiery articles and circular knitting methods utilizing circular hosiery knitting machines.

The recent increased awareness and concern for personal health and fitness has generated a considerable amount of activity in the apparel industry directed to satisfying the correspondingly increasing market for athletic apparel. With the ever increasing numbers of persons actively participating in jogging, running, aerobics, tennis and similar relatively strenuous physical activities which impose considerble forces and stresses on the feet, much attention is presently given to optimizing the protective and comfort features of athletic socks and other athletic footwear particularly designed for such activities.

Substantially all conventional athletic socks are now produced by a circular knitting method or circular hosiery knitting machines and it has long been the practice to knit such socks with a so-called "cushion sole" of a terry pile loop construction. In its simplest form, an athletic sock having this cushion sole feature has a relatively bulky, high denier, absorbent body yarn and a second, normally low denier, ground yarn knit throughout the sock in plated relationship, with the body yarn formed in terry pile loops in at least the lower sole area of the foot portion of the sock and often throughout the entirety thereof. This so-called "single terry" knitted fabric construction provides the sock with an increased thickness and a resulant degree of cushioning for the wearer's foot, as well as enabling the wicking of perspiration away from the foot. However, the terry pile loops in such a single terry fabric have a tendency to substantially flatten under the stresses of strenuous physical exercise, thereby minimizing the intended cushioning and moisture wicking effects.

As a possible solution to these and other inadequacies of such single terry cushion sole athletic socks, it has been proposed to incorporate a second terry body yarn in the "cushion" areas of such socks to provide a second set of terry pile loops for increased cushioning, foot support and moisture absorbing capabilities. Examples of athletic socks of this type are disclosed in U.S. Pat. Nos. 3,793,851; 4,149,249; 4,277,959; and 4,373,361. While this so-called "double terry" knitted fabric construction essentially doubles the amount of yarn and the number of terry loops in the cushion areas of these socks to provide some increased ability for cushioning and moisture absorption, the terry pile loops of each terry yarn are essentially identical in size and shape and are located in identical walewise alignment with one another just as with a single set of terry loops in a single terry fabric. Accordingly, the terry loops in such a double terry fabric have been found to suffer a similar tendency to flatten during strenuous physical activity, thereby minimizing the additional cushioning and wicking effect of the second terry yarn.

In contrast, the present invention provides a novel knitted construction and method for knitting a cushion area having two sets of terry loops of differing heights and staggered orientations with respect to one another whereby the terry loops provide better elongation and upstanding support for one another with resultantly improved cushioning and moisture wicking abilities.

Another disadvantage of the above-discussed conventional double terry fabric is that it must be knitted on a circular knitting machine utilizing a so-called "chopping" yarn feeding finger for the second terry body yarn. The chopping finger is operable to pivot into and out of a yarn feeding position during each revolution of the knitting machine to selectively place the second terry body yarn on only the knitting needles in a section, e.g. one-half, of the needle cylinder and to prevent the receipt of the second yarn by the other cylinder needles. At the rotational speeds at which circular hosiery knitting machines typically are operated, it is difficult to insure the exact synchronization of the chopping finger to the rotation of the needle cylinder to insure the starting and stopping of the second terry body yarn on the same needles during each cylinder revolution. It is therefore not unusual to suffer missed stitches while utilizing a chopping feed finger in this manner and typically this type of knitting machine must be operated at a slower than desirable speed to minimize such defects. Furthermore, the chopping feed finger of such machines is incapable of selectively feeding the second terry body yarn to only selected spaced needles since this would require the repetitive chopping movement of the finger into and out of feeding position for substantially each selected needle during each cylinder revolution and, of course, it is not possible to so precisely control the operation of the chopping finger synchronously with the cylinder.

In contrast, the knitting method of the present invention enables the feed finger for the second terry yarn to be positioned and left stationary at its desired yarn feeding position throughout the entire knitting operation and further permits the selective feeding of the second terry yarn to any desired combination of cylinder needles within the same cylinder revolution.

Another common complaint concerning conventional athletic socks is the failure of the leg portion to provide sufficient elasticity to comfortably accommodate large calf sizes while also preventing slippage of the leg portion of the socks down the wearer's legs. To some extent, these two considerations are divergent in that, to accommodate large size calves, the leg portion of a sock must have a substantial degree of stretchability, which in certain cases may compromise the ability of the leg portion of the sock to hold to the wearer's leg against slipping, whereas a lesser degree of stretchability for the leg portion of the sock better insures against slippage but compromises the ability to accommodate large calf sizes.

Typically, athletic socks are provided with a leg portion or at least an elastic cuff portion of a so-called "mock rib" construction having a stretchable elastic yarn inlaid in periodically spaced wales of the leg or cuff portion, thereby providing the leg or cuff portion with a significant degree of coursewise stretchability. Such mock rib constructions are designated according to the number of wales in which the elastic yarn is inlaid and the number of wales over which the elastic yarn is floated in each repeat of the mock-rib construction. For example, a mock rib construction having the elastic yarn inlaid in every other wale is designated as a one-by-one ($1\times1$) mock rib, a mock rib construction having the elastic yarn inlaid in every third wale is designated as a one-by-two ($1\times2$) mock rib, and so forth. Conventionally, the same mock rib construction is utilized about the entire circumference of the leg or cuff portion of the sock. Accordingly, the leg or cuff portion has the same degree of stretchability about its entire circumference which fails to provide for the necessity that the leg or cuff portion will stretch considerably more in the rear calf area to accommodate the wearer's calf muscles than in the front shin area.

In contrast, the athletic sock of the present invention provides an elastic cuff having distinct and differently stretchable calf and shin areas to enable adequate stretching to conform to and accommodate the wearer's calf muscles while also providing sufficient snugness and support on the wearer's leg to prevent slippage of the leg portion of the sock.

SUMMARY OF THE INVENTION

Accordingly, in its broadest aspect, the present invention provides certain improvements adapted for incorporation in a variety of circularly-knitted articles of the basic type having yarn knitted in circumferential courses and axial wales, preferably an athletic sock or similar hosiery article. The present invention also basically provides certain improvements in methods of circularly-knitting such articles utilizing a circular knitting machine, preferably of the type having respective circles of movable knitting needles and sinkers cooperatively arranged in association for relative knitting movement for forming terry fabric courses.

According to one aspect of the present invention, an improved cushion area for an athletic sock or similar knitted article is provided. The cushion area incorporates two terry yarns and occupies a plurality of successive courses and a plurality of successive wales therein. Briefly and basically described, the first terry yarn is knitted in substantially every successive course in jersey stitches in substantially every successive wale and in terry pile loops intermediate the successive wales. The second terry yarn is knitted in selected ones of the successive courses in jersey stitches in selected spaced ones of the successive wales and in terry pile loops spanning the non-selected successive wales therebetween. In this manner, the terry loops of the first and second terry yarns are staggered walewise with respect to one another to provide upstanding support for one another to maintain upstanding extension and inhibit flattening of the terry loops of the yarns during use of the knitted article.

As preferably incorporated in an athletic sock, the second terry yarn is knitted in alternating course groups each of at least one successive course in jersey stitches in alternating ones of the successive wales and in terry pile loops spanning the intermediate successive wales. The second terry yarn is also knitted in intermediate course groups each of at least one successive course in jersey stitches in the intermediate successive wales and in terry pile loops spanning the alternating successive wales. The terry loops of the second terry yarn are more elongated than the terry loops of the first terry yarn to provide a dual thickness of the terry loops of the two yarns. In this manner, the terry loops of the second terry yarn in the alternate and intermediate courses are staggered walewise with respect to one another and to the terry loops of the first terry yarn so that the terry loops of the first and second yarns provide the aforementioned upstanding support for one another to resist flattening during wearing of the sock. A ground yarn is also knitted in substantially every successive course in jersey stitches in substantially every successive wale in plated relationship with the first and second terry yarns. The cushion area occupies at least a region of the lower sole area of the athletic sock for cushioning the sole area of the wearer's foot. Preferably, another like cushion area occupies at least an area of the leg portion of the sock.

As preferably embodied in an athletic sock, the present invention also provides an improved annular mock-rib elastic cuff portion on the leg portion of the sock. The elastic cuff portion includes a front shin area and a rear calf area at opposite circumferential sides of the cuff portion. The front shin area is of a relatively more frequent rib repeat and the rear calf area is of a relatively less frequent rib repeat to provide the rear calf area with a greater degree of coursewise stretchability than the front shin area. In this manner, the rear calf area is enabled to conform to the shape and size of the wearer's calf and to prevent slippage of the elastic cuff and leg portions on the wearer's leg. Preferably, the elastic cuff portion includes a yarn knitted in a single-jersey stitch construction, approximately one-half of the wales of the cuff at one circumferential side thereof forming the front shin area and the other approximately one-half of the wales of the cuff forming the rear calf area. An elastic yarn is laid in each course in the needle loops of alternate wales in the front shin area and in the needle loops of no more frequent than every third wale in the rear calf area, the elastic yarn floating across the needle loops of all intermediate wales.

The preferred athletic sock of the present invention has a foot portion having a front ankle region formed of plain non-terry knitted construction with substantially the entire remainder of the foot portion being formed of a terry-loop knitted construction. In this manner, the non-terry front ankle region is adapted to conform to the front of the wearer's ankle without wrinkling or folding, thereby to promote the comfort of the wearer. The foot portion basically includes a lower sole area at one circumferential side of the foot portion and an upper instep area at the opposite circumferential side of the foot portion, the lower sole area including ball and heel regions at opposite ends thereof and an arch region therebetween and the upper instep area including the front ankle region at the end thereof adjacent the heel region and a forward instep region adjacent the arch and ball regions. The front ankle area is of a single jersey knitted construction incorporating a first terry yarn, at least a predominant portion of the remainder of the foot portion including at least the arch and ball regions being of a dual-thickness terry loop construction as aforedescribed incorporating the first terry yarn and a second terry yarn forming two sets of integrally-knit terry pile loops and any other regions of the foot portion being of at least a single terry loop construction incorporating one of the terry yarns forming at least one set of integrally-knit terry pile loops.

According to the method of the present invention, the above-described cushion area is formed in a knitted article utilizing a selected group of successive needles and the sinkers associated therewith on a circular knitting machine of the preferred type. Basically, the method provides for the forming of a plurality of first terry fabric courses by feeding a first terry yarn to substantially all the successive needles and their associated sinkers, feeding a second terry yarn to only first selected spaced ones of the successive needles and to their associated sinkers, and manipulating the successive needles and associated sinkers to knit the first terry yarn in needle loops on the successive needles and terry pile loops on the associated sinkers and to knit the second terry yarn in needle loops on the first selected successive needles and terry pile loops on at least one associated sinker intermediate each pair of adjacent selected successive needles. In this manner, the aforementioned walewise staggering of the terry loops of the first and second terry yarns is achieved to provide upstanding support for and inhibit flattening of the terry loops. A plurality of second terry fabric courses are also preferably formed by similarly feeding the first terry yarn to substantially all the successive needles and associated sinkers, feeding the second terry yarn to only second selected spaced ones of the successive needles and to the associated sinkers, and manipulating the successive needles and associated sinkers to knit the first terry yarn in needle loops on the successive needles and terry pile loops on the associated sinkers and to knit the second terry yarn in needle loops on the second selected successive needles and terry pile loops on at least one associated sinker intermediate each pair of adjacent selected successive needles.

In the preferred embodiment, each first course is formed by extending alternate ones of the successive needles to an extended yarn receiving position, while extending the intermediate successive needles to a basic lesser-extending yarn receiving position. The first terry yarn is fed at a basic level relative to the successive needles to be received for knitting by all of the successive needles at both the extended and basic yarn receiving positions and by the associated sinkers. The second terry yarn is fed at an extended level relative to the successive needles to be received for knitting by only the alternate successive needles at the extended yarn receiving position and by the sinkers associated therewith. The manipulation of the successive needles and associated sinkers knits the first terry yarn in needle loops on substantially all of the successive needles and terry pile loops on the sinkers associated therewith and knits the second terry yarn in needle loops on the alternate successive needles and terry pile loops on the sinkers intermediate the alternate successive needles. Similarly, each second course is formed by extending the intermediate successive needles to the extended yarn receiving position and extending the alternate successive needles to the basic yarn receiving position, while feeding the first terry yarn at the basic level to substantially all the successive needles and the sinkers associated therewith the feeding the second terry yarn at the extended level to only the intermediate successive needles and the sinkers associated therewith. The manipulation of the successive needles and associated sinkers knits the first terry yarn in needle loops on the successive needles and terry pile loops on the sinkers associated therewith and knits the second terry yarn in needle loops on the intermediate successive needles and terry pile loops on the sinkers intermediate the intermediate successive needles. In this manner, the terry loops of the second terry yarn in the alternate and intermediate courses are staggered walewise with respect to one another as well as with respect to the terry loops of the first terry yarn, and are also more elongated than the terry loops of the first terry yarn to provide a dual thickness of the terry loops of the two yarns.

Preferably, in forming each of the first and second terry fabric courses, the ground yarn is fed to substantially all the successive needles and the sinkers associated therewith. In one embodiment of the method, two of the first terry courses and two of the second terry courses are formed successively to one another. The circular knitting machines on which the present method is preferably adapted to be performed are of the type having at least two yarn feeding fingers pivotably movable into and out of yarn feeding positions, as well as a yarn cutting mechanism located centrally of the needle cylinder. According to the present method, one of the yarn feeding fingers is positioned to feed the first terry yarn at the basic yarn feeding level and the other yarn feeding finger is positioned stationarily to feed the second terry yarn at the extended yarn feeding level. During the above-described formation of the terry courses of the cushion area, the last successive needle selectively raised to the extended yarn receiving position during the formation of each terry course is operative to carry the second terry yarn to the cutting mechanism for cutting of the yarn without requiring movement of the respective yarn feeding finger from its feeding position at the extended level and without the second terry yarn being received by any of the non-selected needles at the basic yarn receiving position.

DESCRIPTION OF THE PREFERRED EMBODIMENT

Figure 1:
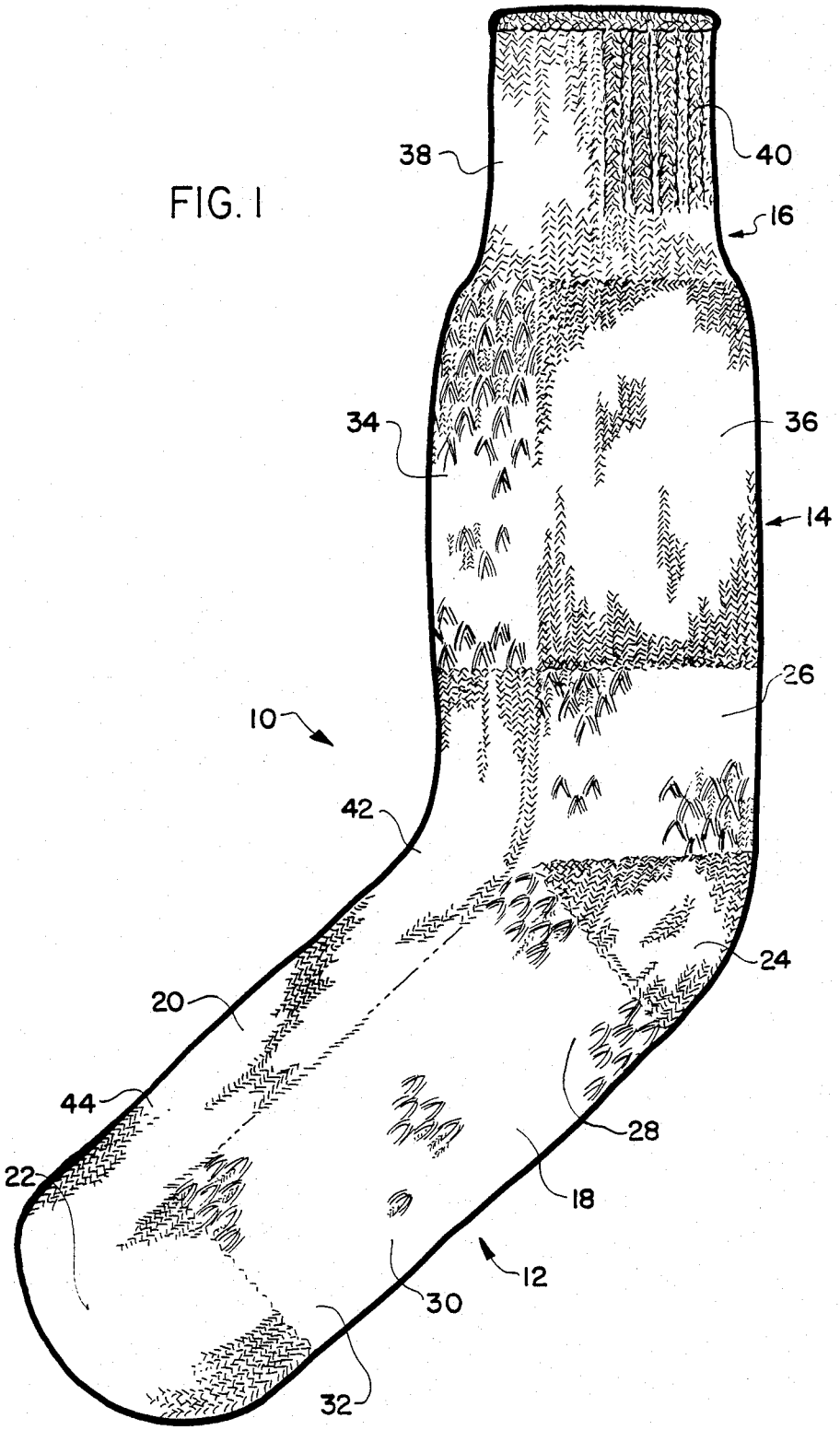
FIG. 1 is side elevational view of an athletic sock according to the preferred embodiment of the present invention.
Figure 2:
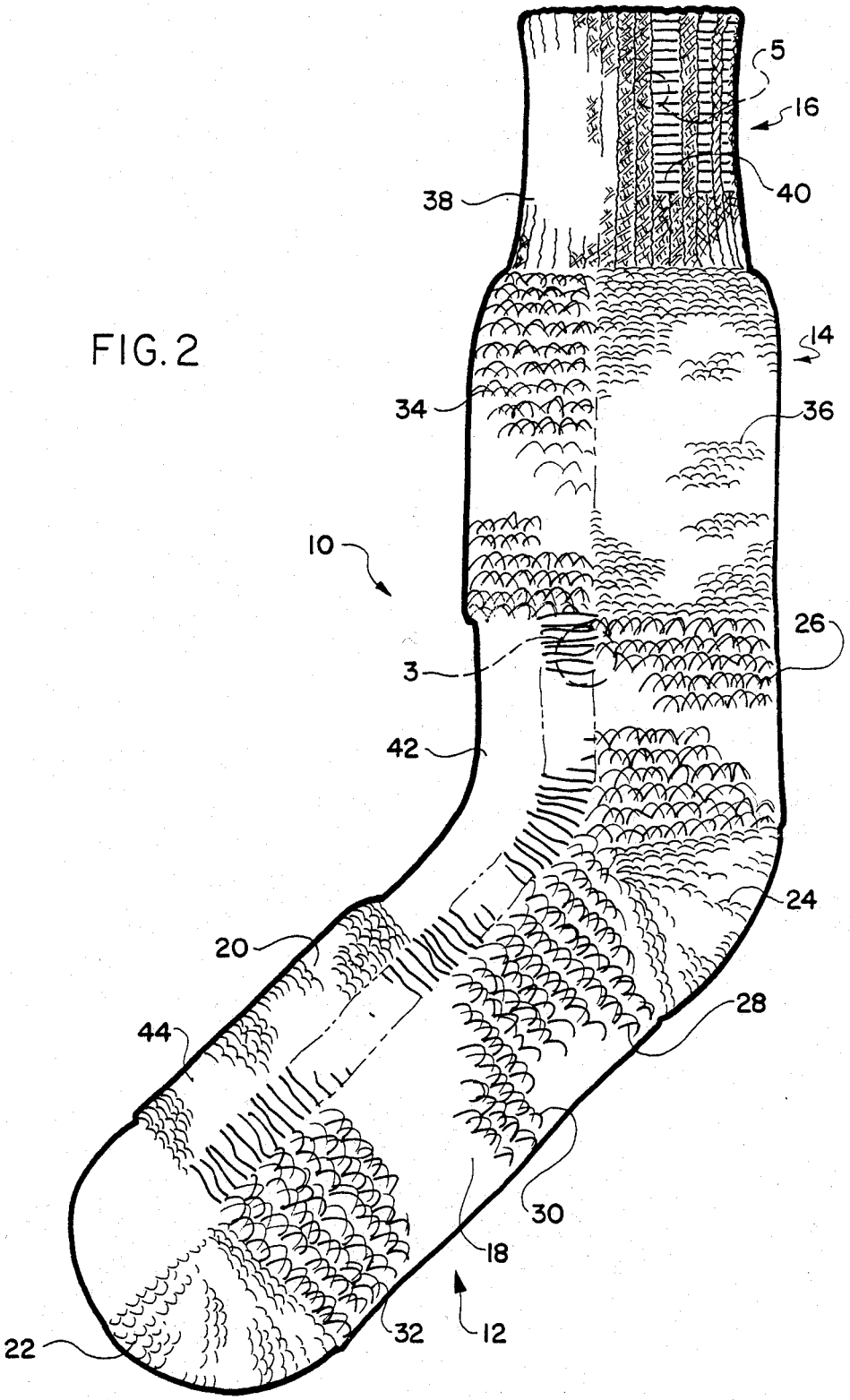
FIG. 2 is a side elevational view similar to FIG. 1 but illustrating the athletic sock in everted condition showing the terry loops in the cushion areas.

Referring now to the accompanying drawings and initially to FIGS. 1 and 2, an athletic sock according to the present invention is indicated generally at 10. The athletic sock 10 is of the type generally referred to as an over-the-calf sock and is particularly adapted for athletic activities such as snow skiing, hiking and the like, although as will be readily understood from the following description, the various features of the present invention may be equally well adapted in substantially any other athletic sock as well as many other types of knitted articles.

The sock 10 is circularly knitted and basically includes a foot portion 12, a leg portion 14 integrally knit with and extending from one end of the foot portion 12, and an elastic cuff portion 16 integrally knit to the extending end of the leg portion 14. The foot portion 12 includes a lower sole area 18 encompassing the lower circumference of the foot portion 12 and an upper instep area 20 encompassing the remaining upper circumference of the foot portion 12. The lower sole area 18 includes a reciprocally-knitted toe pocket region 22 at the free end of the foot portion 16 and a reciprocally-knitted heel pocket region 4 adjacent the opposite end of the foot portion 12. A high splice region 26 and a low splice region 28 extend respectively above and below the heel pocket region 24. An arch region 30 extends from the sole splice region 28 and a ball region 32 extends between the arch region 30 and the toe pocket region 22. The upper instep area 20 includes a front ankle region 42 at the end thereof adjacent the heel pocket region 24 and a forward instep region 44 adjacent the arch and ball regions 30,32. The leg portion 14 basically includes a front shin area 34 and a rear calf area 36, and the elastic cuff portion 16 similarly includes a front shin area 38 and a rear calf area 40.

The athletic sock 10 is preferably knitted on a circular hosiery knitting machine (FIGS. 6–11), as more fully explained hereinafter, and includes a plurality of yarns formed in needle, sinker and terry loops extending in a plurality of circumferential courses and axial wales. The sock 10 is knitted throughout the entirety thereof of a first body yarn B and a ground yarn G knitted in plated relationship in a basic single jersey stitch construction. In the elastic cuff portion 16, an elastic yarn E is inlaid periodically on the inward so-called "reverse" side of the knitted fabric in the single jersey stitch construction of each course of the body and ground yarns B,G in a mock-rib fashion. Throughout the entire leg portion 14 and the foot portion 12, except for the front ankle region 42, the first body yarn B is utilized as a terry yarn and is also formed in a set of terry pile loops and, in the front shin region 34 of the leg portion 14 and the high splice, sole splice, arch and ball regions 26,28,30,32, respectively, of the foot portion 12, a second terry body yarn T is formed in another set of terry pile loops, thereby to provide integrally-knit terry cushion areas of single and double thicknesses on the inward, reverse side of the sock 10 for improved cushioning of and moisture absorption from the wearer's foot. The front ankle region 42 of the foot portion 12 is formed only of a single jersey, non-terry stitch construction of the first terry body yarn B and the ground yarn G and, therefore, is the only region of the foot and leg portions 12,14 of sock 10 of a non-terry construction.

Preferably, the two terry body yarns B,T are relatively bulky, high denier spun yarns formed of absorbent hydrophilic fibers such as acrylic, cotton, wool or the like. The primary function of the ground yarn G is to provide a jersey fabric base or ground to maintain the terry fabric construction of the terry body yarns B,T in the cushion areas. Accordingly, the ground yarn G preferably is a relatively strong, low denier filament yarn and need not have any affinity for moisture absorption. For example, the ground yarn may be a nylon, polyester or like yarn.

Figure 5:
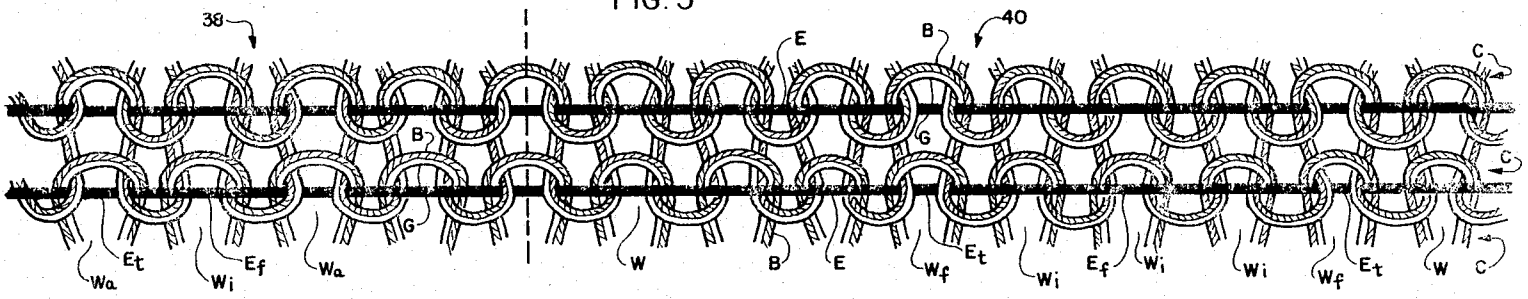
FIG. 5 is an enlarged schematic elevational view of the sock of FIGS. 1 and 2 taken at the junction between the rear calf and front shin areas of the elastic cuff within the area 5 encircled in FIG. 2.

In FIG. 5, a fragmentary portion of the knitted construction of the elastic cuff portion 16 is shown through several courses C and wales W of the cuff portion 16 at one junction between the front shin and rear calf areas 38,40 thereof. As previously mentioned, the first terry body yarn T and the ground yarn G are knitted throughout the elastic cuff portion 16 in single jersey stitch construction having the terry body and ground yarns B,G formed in plated relationship to one another in respective needle loops $B_n$,$G_n$ in each wale W of each course C and in respective sinker loops $B_s$,$G_s$ intermediate the wales W of each course C. According to the present invention, the front shin area 38 is formed of a one-by-one ($1\times1$) mock rib construction having the elastic yarn E inlaid on the reverse side of the fabric of the cuff portion in each course C by inlaid tuck stitches $E_t$ in the needle loops $B_n$,$G_n$ in alternate wales $W_a$, with float stitches $E_f$ of the elastic yarn E extending across the needle loops $B_n$,$G_n$ of the intermediate wales $W_i$. The rear calf area 40 of the elastic cuff portion 16 is of a one-by-three ($1\times3$) mock rib construction having the elastic yarn E inlaid in each course C by tuck stitches $E_t$ in the needle loops $B_n$,$G_n$ in every fourth wale $W_f$, with float stitches $E_f$ of the elastic yarn E extending across the needle loops $B_n$,$G_n$ of each set of three intermediate wales $W_i$.

Of course, those persons skilled in the art will readily recognize that the front shin and rear calf areas 38,40 of the elastic cuff portion 16 could also be formed of any other varied combination of mock rib constructions, it being principally important under the present invention that the mock rib repeat in the front shin 38 be relatively frequent and the mock rib repeat of the rear calf area 40 be relatively infrequent. In this manner, the rear calf area 40, which must fit about the wearer's calf muscle which may be relatively well developed and large in athletes, has a greater degree of stretchability than the front shin area 38, which merely fits about the wearer's shin and does not require significant stretchability. Thus, the elastic cuff portion 16 serves the two-fold purpose of stretchably and comfortably conforming to the shape and size of the wearer's calf while also providing sufficient snugness to prevent slippage of the leg and cuff portions 14,16 of the sock 10 on the wearer's leg.

Figure 3:
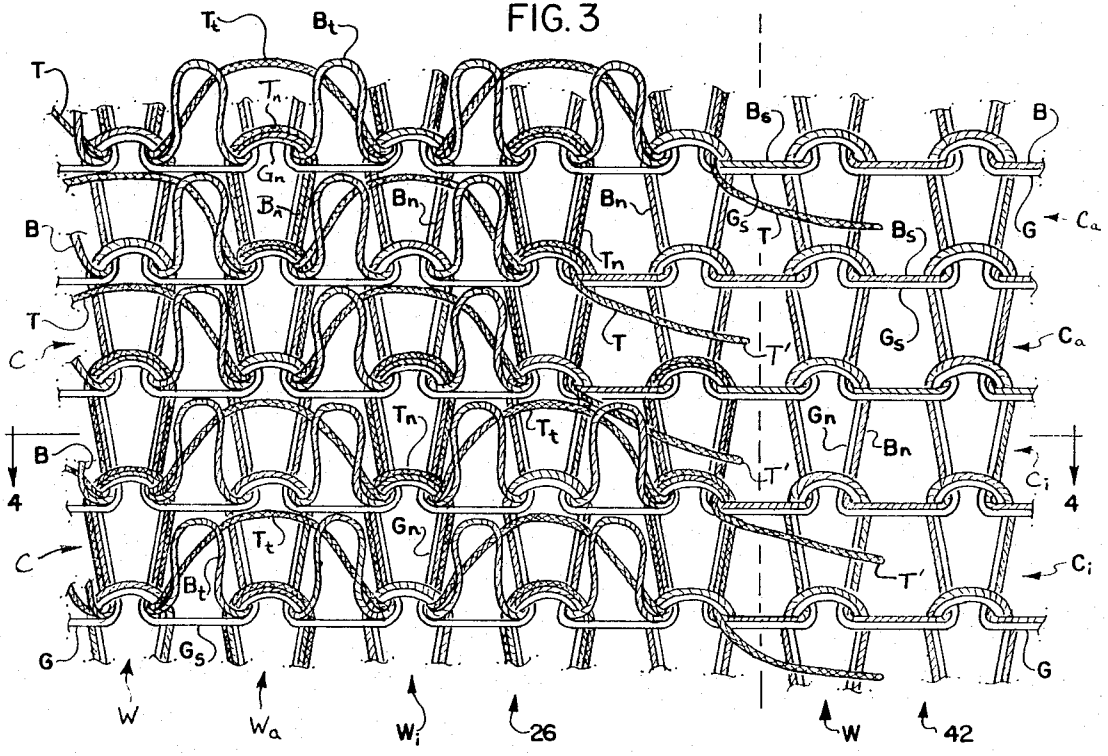
FIG. 3 is an enlarged schematic elevational view of the inside surface of the sock of FIGS. 1 and 2 taken at the junction between the dual terry cushion sole and front ankle regions within the area 3 encircled in FIG. 2.
Figure 4:
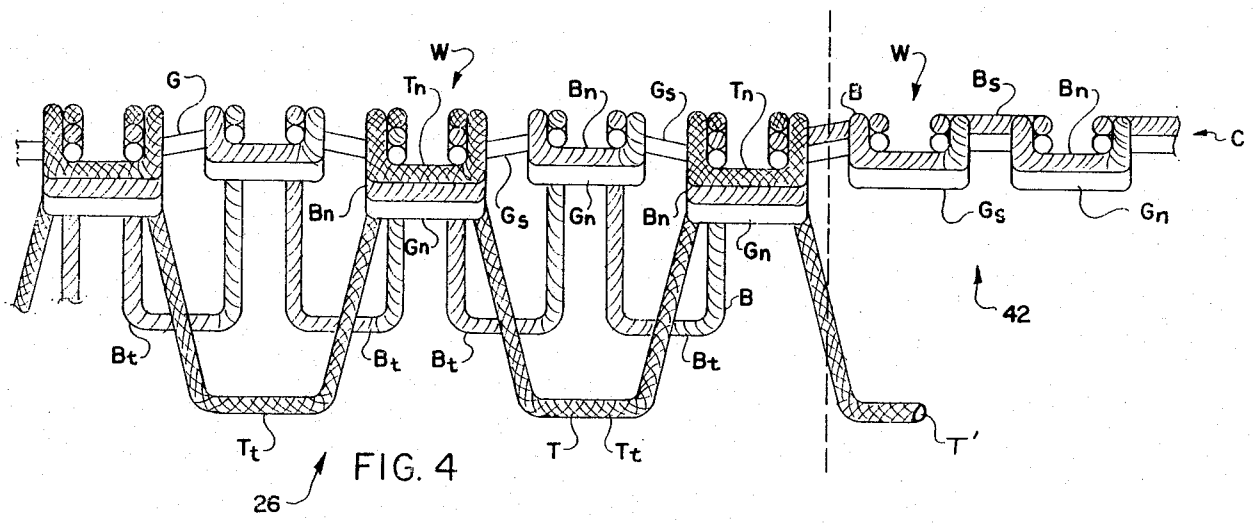
FIG. 4 is a coursewise horizontal sectional view taken along line 4—4 of FIG. 3.

In FIGS. 3 and 4, the knitted construction of the dual-thickness terry cushion areas is schematically shown in a substantially enlarged fragmentary view of several courses C and wales W at the junction between the high splice region 26 and the front ankle region 42 of the foot portion 12. The athletic sock 10 includes three distinct such dual terry cushion areas, namely, first dual terry cushion area occupying the front shin area 34 of the leg portion 14, a second dual terry cushion area occupying the high splice region 26 of the foot portion 12, and a third dual terry cushion area occupying the sole splice, arch, and ball regions 26,28,30 of the foot portion 12. Each such dual terry cushion area therefore occupies a plurality of successive courses C and a plurality of successive wales W therein and is formed coursewise adjacent a distinct fabric area of only single jersey or single terry construction. However, those persons skilled in the art will readily recognize and understand that, if desired, any such dual terry cushion area according to the present invention could be formed to extend about the full circumferential coursewise extent of the sock 10 and further, if desired, for the full walewise extent of the foot and leg portions 12,14 thereof.

In each such dual terry cushion area, the ground yarn G is knitted in every course C in single jersey stitch construction in needle loops $G_n$ in every wale W and in sinker loops $G_s$ intermediate the wales W of the area. The first terry body yarn B is knitted as a terry yarn in every course C of the area in single jersey needle loops $B_n$ in every wale W in plated relationship with the needle loops $G_n$ of the ground yarn G and in elongated terry pile loops $B_t$ intermediate the wales W of the area. The second terry body yarn T is knitted in alternate pairs of successive courses $C_a$ in single jersey needle loops $T_n$ in every alternate wale $W_a$ in plated relationship with the needle loops $G_n$,$B_n$ of the ground and first terry body yarns G,B and in more elongated terry pile loops $T_t$ spanning the intermediate wales $W_i$. The second terry body yarn T is similarly knitted in the intermediate pairs of successive courses $C_i$ between the alternate course pairs $C_a$ in single jersey needle loops $T_n$ in every intermediate wale $W_i$ in plated relationship with the needle loops $G_n$,$B_n$ of the ground and first terry body yarns G,B and in more elongated terry pile loops $T_t$ spanning the alternate wales $W_a$.

It is to be understood that the illustration of the dual terry cushion area of FIGS. 3 and 4 is schematic and therefore shows the needle loops $G_n$,$B_n$,$T_n$ of each yarn G,B,T to illustrate the plated relationship thereof. In the actual knitted fabric, the second terry body yarn T will appear on the outward or so-called "face" side of the knitted fabric in every stitch in which all three yarns are incorporated and the first terry body yarn B will similarly appear on the outward face side of the fabric in all stitches in which only the ground and first terry body yarns G,B are incorporated, with the ground yarn G appearing on the inward reverse side of the fabric in each such stitch. Additionally, it is to be understood that the terry pile loops $B_t$,$T_t$ of the terry body yarns B,T are considerably more elongated in relation to the needle loops $B_n$,$T_n$ in the actual knitted fabric than is shown in the illustrations of FIGS. 3 and 4, the terry loops $B_t$,$T_t$ being somewhat reduced and the needle loops $B_n$,$T_n$ being enlarged somewhat in such Figures for purposes of clarity of illustration and understanding.

The second terry body yarn T is cut in each course $C_a$,$C_i$ in each double terry cushion area at each coursewise juncture between the successive wales of the double terry area and the coursewise adjacent area, e.g. the front ankle region 42, to produce cut ends as indicated at T' in FIGS. 3 and 4. In the courses C of the high splice and sole splice regions 26,28 which extend through the front ankle region 42, the body and ground yarns B,G are knitted through the front ankle region 42 in plated single jersey stitch construction of respective needle loops $B_n$,$G_n$ and sinker loops $B_s$,$G_s$, but without the formation of terry pile loops $B_t$ of the terry body yarn B. In the other courses C through the double terry cushion areas in the front shin area 34 of the leg portion 14 and in the arch and ball regions 30,32 of the foot portion 12, the terry body yarn B and the ground yarn G continue through the coursewise adjacent regions in the same single terry pile loop stitch construction of the terry body yarn B and ground yarn G as in the dual terry cushion areas. Similarly, in the reciprocally-knitted toe pocket and heel pocket regions 22,24, the second terry yarn T is omitted and the first terry body yarn B and the ground yarn G are formed in the same single terry pile loop construction.

As will thus be understood, the two terry body yarns B,T form two sets of terry pile loops $B_t$,$T_t$ in each dual terry cushion area to provide a substantially increased density of terry pile loops in these areas. Furthermore, the two sets of terry pile loops $B_t$,$T_t$ are of differing upstanding loop heights, the terry loops $T_t$ being more elongated than the terry loops $B_t$, to provide a dual thickness to each such dual terry cushion area. Additionally, the terry loops $T_t$ of the terry yarn T in the alternate and intermediate courses $C_a$,$C_i$ are staggered walewise with respect to one another, as well as being staggered walewise with respect to the terry loops $B_t$ of the first terry body yarn B. Thus, the dual terry cushion area construction of the present invention is substantially contrasted to conventional double terry constructions wherein the two sets of terry loops are of identical sizes and shapes and are oriented in exact walewise alignment with one another. As a result, the two sets of terry pile loops $B_t$,$T_t$ of the present cushion area provide coursewise and walewise upstanding support for one another, whereby the two sets of terry pile loops $B_t$,$T_t$ tend to maintain one another in upstanding extension and elongation and tend to resist flattening of the loops during wearing and use of the sock. Accordingly, the terry pile loops $B_t$,$T_t$ provide enhanced cushioning of the wearer's foot and are better able to wick perspiration and moisture away from the foot.

Of course, any other coursewise and walewise staggering of the two sets of terry pile loops $B_t$,$T_t$ could be equally well utilized with similar effects and advantages. For example, the courses $C_a$,$C_i$ could be alternated individually rather than in pairs. Also, the second terry yarn T could be knit in every third wale W rather than in every alternate wale W to produce longer terry loops $T_t$ and a differingly staggered arrangement thereof. It will also be appreciated that the double terry cushion area of the present invention could be equally utilized in other knitted articles, e.g., leg warmers, headbands, wristbands, etc.

As previously mentioned, the front ankle region 42 is the only region of the foot and leg portions 12,14 of the sock 10 of a non-terry construction, the front ankle region 42 having only the ground yarn G and the first terry body yarn B knitted in single jersey stitch construction. The resultant distinction between the dual terry cushion area of the high splice region 26 and the front angle region 42 will be readily seen and understood in FIGS. 2–4. Because of the considerable bulk of the single and dual terry cushion areas of the foot and leg portions 12,14 of the sock 10, it will be understood that a substantial tendency exists for the front ankle region 42 to wrinkle and gather in spite of the contoured shape provided by the reciprocally-knitted heel pocket region 24. Therefore, in the front ankle region 42, any terry loop cushioning may tend to bind the ankle of the wearer and cause discomfort, particularly under the constriction of typically close-fitting athletic shoes. Accordingly, the reduced thickness of the single jersey front ankle region 42 better enables the sock 10 in this region to conform to the foot of the wearer without wrinkling, bunching or folding and thereby better promotes the comfort of the wearer. However, in contrast to other athletic socks, the entire instep area 20 of the foot portion 12 in the present sock 10 is not of the reduced thickness and single jersey construction of the front ankle region 42. Instead, such single jersey non-terry construction is limited to only that portion of the instep area 20 at the front of the wearer's ankle at which wrinkling is likely to occur, the remainder of the instep area 20 being of a single terry loop construction to provide maximum cushioning and comfort about the entirety of the wearer's foot.

Turning now to the particular method of the present invention by which the athletic sock 10 is knitted and with particular reference to FIGS. 6–11, the present method is preferably performed on a circular knitting machine of the hosiery type having the capability for both rotational and reciprocal knitting motions together with the capacity for knitting terry-type fabrics. Circular knitting machines of this basic type are conventional and known and, therefore, for clarity and succinctness of the illustration and description of the present method, the machine and its operation are illustrated and described herein only insofar as is necessary to facilitate a complete understanding of the method of the present invention.

The knitting machine basically includes a rotatable needle cylinder (not shown) of a relatively small diameter with axial needle slots formed at a coarse-gauge spacing from one another about the outer circumferential surface of the cylinder. A plurality of latch-type knitting needles 50, each having a yarn-receiving hook 50' and a closeable latch assembly 50" are reciprocably disposed within the axial cylinder slots. A sinker ring (also not shown) having a plurality of radial slots formed at a similar coarse-gauge spacing thereabout is disposed annularly and coaxially about the upper end of the needle cylinder for synchronous rotation therewith. A plurality of loop-forming sinkers 52 are reciprocably carried in the radial slots of the sinker ring for movement of the sinkers 52 transversely of and between the cylinder needles 50. The sinkers 52 are of the known terry-type having a lower basic yarn receiving surface 52' and an upper raised yarn receiving surface 52" over which sinker loops and terry pile loops, respectively, may be formed during plated knitting of two yarns to facilitate the formation of the above-described terry-type cushion area construction in the foot and leg portions 12,14 of the sock 10.

Figure 6:
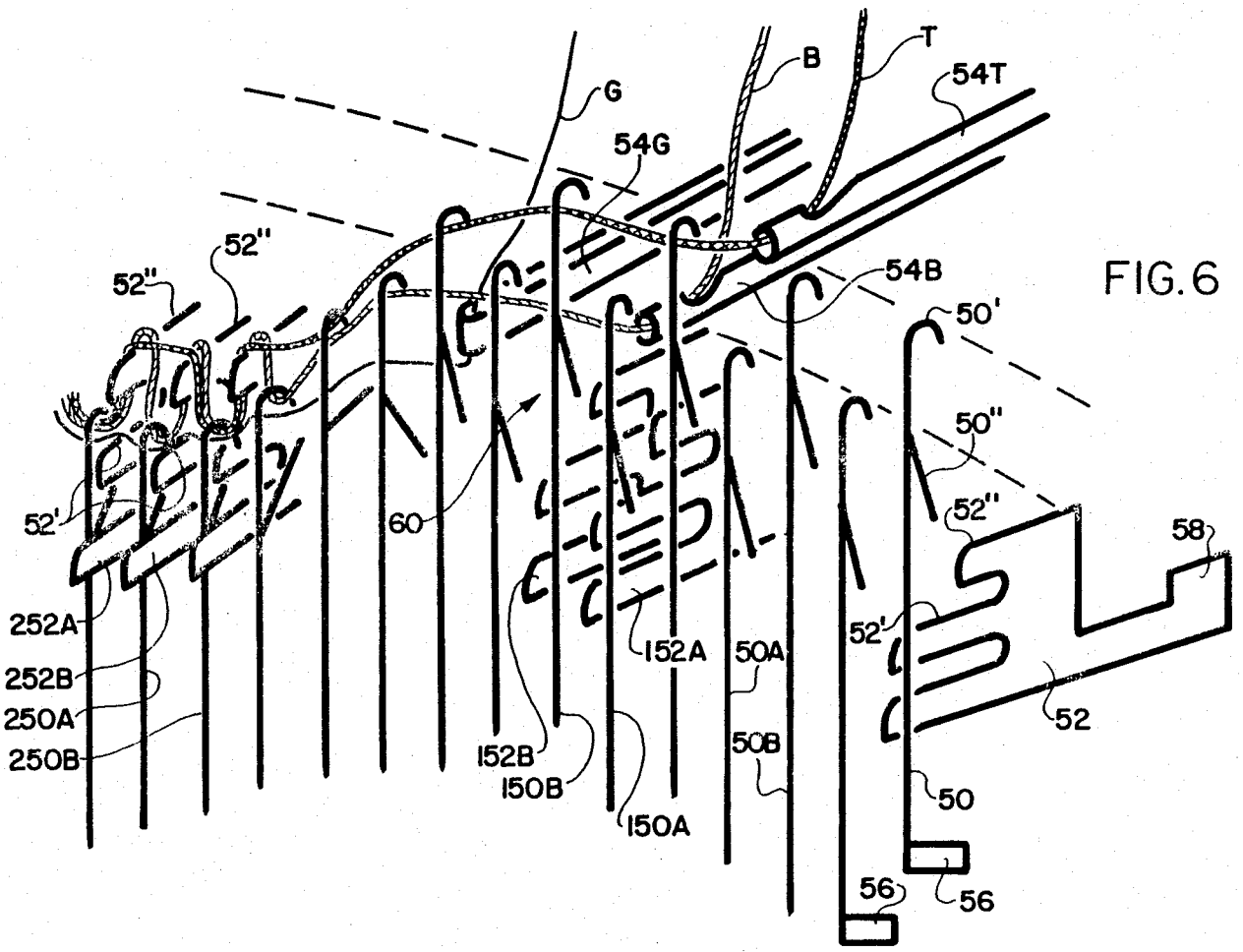
FIG. 6 is a schematic perspective view of the preferred circular knitting machine for knitting the athletic sock of FIGS. 1 and 2 according to the method of the present invention, taken at the knitting station of the machine.

The knitting machine has a single knitting station, indicated at 60 in FIG. 6, at which a plurality of yarn feeding fingers 54 are pivotably movable into and out of yarn feeding positions adjacent the upper end of the needle cylinder to feed yarns to the needles 50 and sinkers 52 thereat. An elastic yarn feeding arrangement is also provided at a spacing from the knitting station 60 for feeding the elastic yarn E. The needles 50 and sinkers 52 are operably manipulated within the cylinder and sinker ring slots, respectively, by stationary needle and sinker cams positioned adjacent the needle cylinder and sinker ring to engage and act on needle and sinker butts 56,58 formed respectively on the needles 50 and the sinkers 52 during rotation of the needle cylinder and sinker ring.

A needle jack (not shown) is positioned in each cylinder slot below the needle 50 thereof and a jack selector mechanism (also not shown) is positioned adjacent the needle cylinder slightly in advance of the knitting station to actuate the selective raising of the jack to act on their associated needles 50 to raise the needles 50 into active position for cammed knitting manipulation thereof at the knitting station.

The sinker cams are contained within a so-called sinker cap (not shown) which is mounted on the sinker ring and is operatively positionable at either an inactive position spaced from the sinker ring to be out of contact with the sinker butts so that the sinkers are inactive for terry-knitting operation, an active position adjacent the sinker ring for full active manipulative sinker operation on their sinker butts, and an intermediate active position adjacent the sinker ring for active manipulative sinker operation on only long butt sinkers.

The machine is operable to carry out the knitting of a sock in conventional manner from the leg portion to the foot portion and an appropriate control arrangement is provided for determining the necessary transitional changes in the machine operation to form each sock portion, area and region.

Figure 7:
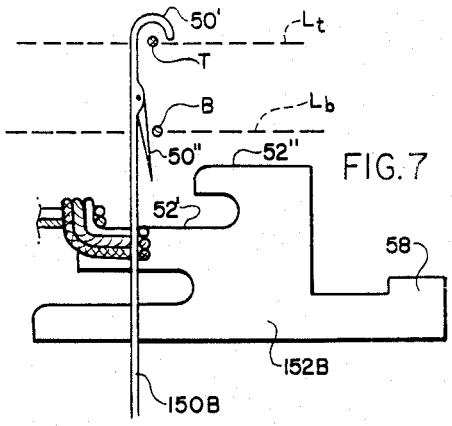
FIGS. 7–10 are schematic side elevational views illustrating various ones of the needles and associated sinkers of the knitting machine of FIG. 6.
Figure 8:
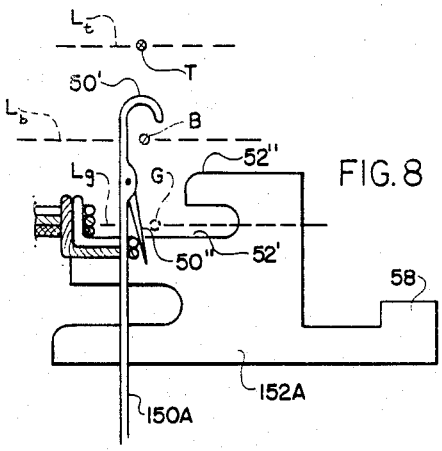

According to the present method, the jack selector arrangement is adapted through an associated pattern drum or the like for selectively raising the needles 50 within their respective cylinder slots in advance of the knitting station 60 to project the needles from the upper end of the cylinder at either a basic yarn receiving position, indicated by the needles 50A, or a more extended yarn receiving position, indicated by the needles 50B. As best seen in FIGS. 6–8, the open hook and latch areas of respective needles 50A,50B at the basic and extended yarn receiving positions have some corresponding area of overlap to permit feeding of yarn at a level within such overlap area for receipt by the needles 50A,50B at both the basic and extended positions, as explained hereinafter.

At least three of the yarn feeding fingers 54 are provided at the knitting station 60 according to the present invention, for respectively feeding the ground and two terry yarns G,B,T. One yarn feeding finger, indicated at 54B, is adapted to feed the first terry body yarn B at a basic terry yarn feeding level, indicated at $L_b$, for receipt within the open hook and latch areas of all active raised needles 50A and 50B at both the basic and extended yarn receiving positions and for receipt by the sinkers 52 over their upper raised yarn receiving surfaces 52". Another yarn feeding finger, indicated at 54T, is adapted to feed the second terry body yarn T at an extended terry yarn feeding level, indicated at $L_t$, above the hooks 50' of the needles 50A at the basic yarn receiving position for receipt of the second terry body yarn T only within the open hook and latch areas of the active raised needles 50B at the extended yarn receiving position and for receipt by the sinkers 52 over their upper raised yarn receiving surfaces 52". As those persons skilled in the art will understand, the stitch cams of the knitting machine are located in the area of the knitting station 60. A so-called centering cam is included with the needle cams generally centrally in the area of the knitting station 60 and is adapted to withdraw the needles 50B from the extended yarn receiving position to the same basic yarn receiving position as the needles 50A, in preparation for manipulation of all of the needles 50A,50B by the needle stitch cam at the knitting station 60. Thus, the yarn feeding fingers 54B and 54T are located at the knitting station 60 in advance of the centering cam to deliver the two terry yarns B,T to the needles 50A,50B while such needles remain respectively positioned at the basic and extended yarn receiving positions. The third yarn feeding finger, indicated at 54G, is located at the knitting station following the centering cam and is adapted for feeding the ground yarn G to all of the needles 50A,50B after manipulation of the needles 50B to the basic yarn receiving position by the centering cam and in advance of further withdrawing needle manipulation by the stitch cam. The yarn feeding finger 54G is adapted to feed the ground yarn G at a normal non-terry yarn feeding level, indicated at $L_g$, to the open hook and latch areas of all of the active raised needles 50A,50B and for receipt by the sinkers 52 over their basic yarn receiving surfaces 52'.

In accordance with the normal operation of the machine as previously mentioned, the sock 10 is knit from its elastic cuff portion 16 progressively through the leg portion 14 and foot portion 12 and is completed with the knitting of the toe pocket region 22. To begin the operation of the machine, the sinkers are deactivated and alternate ones of the needles 50 are raised to a so-called tuck position at the elastic yarn feeding finger while the intermediate needles 50 remain inactively withdrawn within the needle cylinder. The elastic yarn E is fed to the alternate needles for several initial revolutions of the needle cylinder. Thereafter, all of the needles 50 are raised to the basic yarn receiving position, while the sinkers 52 remain deactivated and the first terry body yarn B and the ground yarn G are fed to the needles 50 for knitting in plated relationship in single jersey stitch construction. During the first such revolution of the needle cylinder following the formation of the make-up rounds of elastic yarn E, a first circumferential course of needle and sinker loops of the first terry body and ground yarns B,G are formed, the make-up rounds of the elastic yarn E being shed from the needles 50 and the needle loops of the first terry body and ground yarns B,G being formed around and encircling the elastic make-up rounds in conventional manner.

For a plurality of subsequent revolutions of the needle cylinder, selected ones of the needles 50 are raised to the tuck position at the elastic yarn feeding finger in advance of the knitting station 60. As will be understood, the latch assemblies 50'' of such selected needles 50 open but the needle loops of the yarns B,G previously formed on the selective needles are not shed below the open latch assemblies 50''. The elastic yarn E continues to be fed to each such selected needle, following which the feeding and knitting of the ground and first terry body yarns G,B in single jersey construction proceeds at the knitting station 60 as above-described during each cylinder revolution. In this manner, the elastic yarn E is inlaid in selected wales in the knitted courses of the elastic cuff portion 16 to produce a mock-rib construction as above-described.

According to the present invention, during each revolution of the knitting cylinder for the formation of the elastic cuff portion 16, alternate ones of the needles 50 at one circumferential half of the needle cylinder and every fourth needle 50 at the other circumferential half of the needle cylinder are raised to the tuck position for inlaying of the elastic yarn E as above-described. In this manner, the elastic cuff portion 16 is formed in a 1×1 mock rib construction through the successive wales at one circumferential half of every course through the cuff portion 16, and in a 1×3 mock rib construction in the successive wales at the other circumferential half of every course through the cuff portion 16. As will be understood, the elastic cuff portion 16 way be formed of any selected length as desired by varying the number of revolutions of the machine for which the above-described cuff-forming operation is carried out. In the sock 10, the cuff portion 16 is formed only of a sufficient length to provide enough elasticity at the top of the leg portion 14 to hold the leg and cuff portions 14,16 against sliding along the wearer's leg. However, in other athletic socks, it may be desirable to form the entire leg portion of the described elastic cuff construction.

Following the completion of the last revolution of the needle cylinder during the formation of the cuff portion 16, the sinkers 52 are activated to begin the knitting of the leg portion 14. For the knitting of the leg portion 14, a selected number of successive ones of the needles 50 centered within the group of needles 50 utilized for knitting the 1×1 mock rib construction in the cuff portion 16, constituting approximately one-third of the total number of needles in the cylinder, are designated for knitting the above-described dual terry cushion area through the front shin region 34 of the leg portion 14. The remaining needles, constituting the other approximately two-thirds successive needles in the needle cylinder, are designated for forming the single terry cushion area through the rear calf area 36 of the leg portion 14. For convenient reference hereinafter, the first group of one-third of the cylinder needles will be identified as Group I, while the remaining group of two-thirds of the cylinder needles will be identified as Group II.

For the first two revolutions of the needle cylinder in the knitting of the leg portion 14, alternate ones of the needles of Group I are raised within the needle cylinder to the extended yarn receiving position, while the intermediate needles of Group I and all of the needles of Group II are raised to the basic yarn receiving position. The second terry body yarn T is fed at the extended terry yarn feeding level $L_t$, while the first terry body yarn B and the ground yarn G continue to be fed respectively at the basic terry and normal non-terry yarn feeding levels $L_b$,$L_g$. The alternate needles of Group I and each of the intermediate associated sinkers therebetween receive and knit each of the yarns T,B,G while the intermediate needles of Group I, the needles of Group II and their intermediate associated sinkers receive and knit only the first terry body yarn B and the ground yarn G. During each revolution, the knitting manipulation of the needles and sinkers operates to form plated needle loops of each of the terry and ground yarns B,T,G in the hook and latch areas of the alternate needles of Group I, plated needle loops of the ground and first terry body yarns G,B in the hook and latch areas of the intermediate needles of Group I and the needles of Group II, a sinker loop of the ground yarn G on the basic yarn receiving surface of each sinker, a terry loop of the first terry body yarn B on the upper raised yarn receiving surface of each sinker, and a terry loop of the second terry body yarn T on the upper raised yarn receiving surfaces of the two sinkers intermediate each pair of adjacent successive alternate needles of Group I. For the next two revolutions of the cylinder, the yarns B,T,G continue to be fed at the same respective levels, while the intermediate needles of Group I are raised to the extended yarn receiving position to receive each of the yarns B,T,G and the alternate needles of Group I and all of the needles of Group II are raised to the basic yarn receiving position to receive only the ground and first terry body yarns G,B. For each such revolution of the cylinder, the knitting manipulation of the needles and cylinders operates to form plated needle loops of each yarn B,T,G in the hook and latch area of each intermediate needle of Group I, plated needle loops of the ground and first terry body yarn G,B in the hook and latch area of each alternate needle of Group I and each needle of Group II, a sinker loop of the ground yarn G on the basic yarn receiving surface of each sinker, a terry loop of the first terry body yarn B on the raised yarn receiving surface of each sinker, and a terry pile loop of the second terry body yarn T on the raised yarn receiving surfaces of each pair of sinkers intermediate each pair of adjacent successive intermediate needles of Group I. This described cycle of four revolutions of the knitting machine is repeated continuously until the desired length of the leg portion 14 has been formed.

The basic manner of knitting the leg portion 14 will be more particularly understood with reference to FIGS. 6–10. FIG. 6 illustrated schematically a fragmentary portion of the associated circles of needles and sinkers in the cylinder and sinker ring of the knitting machine at the location of the knitting station during a representative revolution of the knitting machine in the formation of the leg portion 14, showing the basic feeding action of the yarns B,T,G and the basic knitting action of the needles and sinkers for the needles of Group I designated for knitting the double terry front shin area 34. As illustrated, every other needle 50 approaching the knitting station 60 has been raised to the extended yarn receiving position, as indicated at 50B, with the remaining needles 50 therebetween having been raised to the basic yarn receiving position, as indicated at 50A. As will be understood, as the needles of Group II (not shown) subsequently approach the knitting station 60, such needle will be positioned at the basic yarn receiving position identically to the needles 50A. As the extended needles 50B pass through the central area of the knitting station 60, they are manipulated by the aforementioned centering cam to be withdrawn to the basic yarn receiving position, and immediately thereafter the stitch cam at the knitting station manipulates the needles to fully withdraw into the needle cylinder thereby drawing the yarns B,T,G over the respective surfaces of the sinkers 52 to form the needle, sinker and terry loops as aforementioned.

FIGS. 7–10 illustrate the action of the individual needles 150A,150B, 250A,250B of FIG. 6. Thus, in FIG. 7, the needle 150B is shown at the extended yarn receiving position during its movement past the knitting station 60. The first terry yarn B is being fed at the basic terry yarn feeding level $L_b$ and the second terry body yarn T is being fed at the extended yarn feeding level $L_t$, both terry yarns B,T being thereby received within the open hook and latch area of the needle 150B. The respective feeding levels of the terry yarn B,T are both above the level of the raised yarn receiving surface 52'' of the associated sinker 52, but at this point in the rotation of the needle cylinder and sinker ring the associated sinker 52 is radially outwardly withdrawn with respect to the needle 150B. In FIG. 8, the adjacent following needle 150A is shown at the basic yarn receiving position in which the open hook and latch area thereof is positioned to receive the first terry body yarn B at the basic terry yarn feeding level $L_b$ but is below the extended terry yarn feeding level $L_t$ to miss the second terry body yarn T. The associated sinker 52 is also radially outwardly withdrawn with respect to the needle 150A. As will be understood, the sinkers 52 remain radially outwardly withdrawn until reaching the location of the ground yarn feeding finger 54G to permit the ground yarn G to be inserted between the needles and sinkers onto the basic yarn receiving surface 52' of the sinkers 52, as indicated by the broken line representation of the ground yarn G in FIG. 8.

Figure 9:
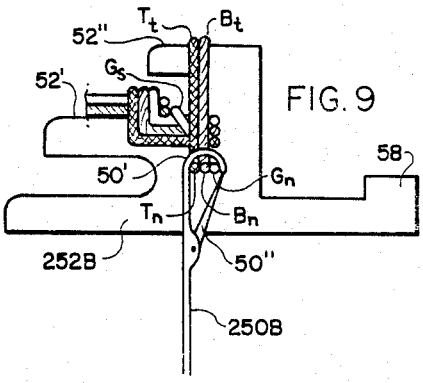
Figure 10:
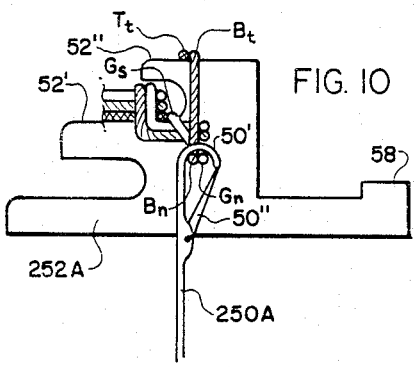
Figure 11:
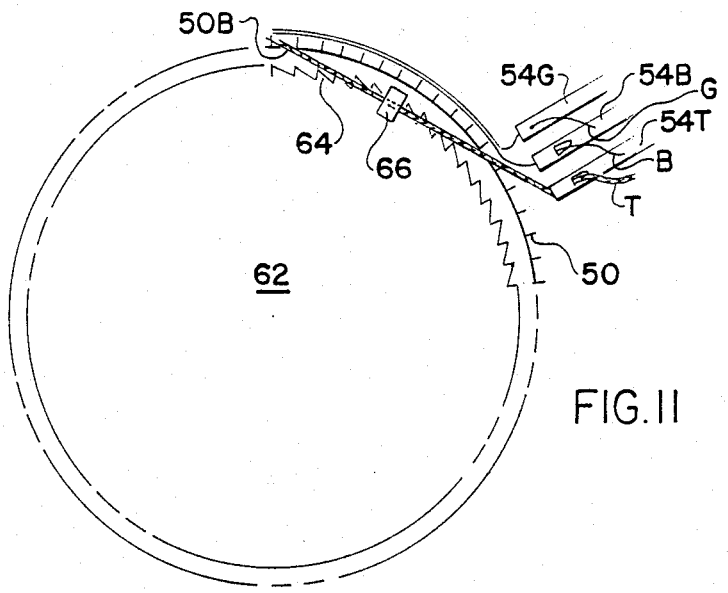
FIG. 11 is a schematic top plan view of the cylinder and dial area of the preferred knitting machine of FIG. 6.

FIG. 9 illustrates the needle 250B and its associated sinker at the point in the rotation of the needle cylinder and sinker ring at which the needle 250B has been fully withdrawn in the needle cylinder by the stitch cam and the associated sinker 52 has been extended radially inwardly with respect to the needle 250B. Thus, the needle 250B has drawn plated needle loops $B_n,T_n,G_n$ of the three yarns B,T,G which are held within the closed hook and latch area of the needle 250B. A sinker loop $G_s$ extends over the basic yarn receiving surface 52' of the associated sinker 52 and terry pile loops $B_t,T_t$ of the two terry yarns B,T extend over the upper raised yarn receiving surface 52'' of the associated sinker 52. Similarly, in FIG. 10, the adjacent preceding needle 250A is shown at the same withdrawn stitch-forming position, with the associated sinker 52 at the same radially inward position. Plated needle loops $B_n,G_n$ have been drawn by and are held within the closed hook and latch area of the needle 250A, with a sinker loop $G_s$ of the ground yarn G extending over the basic yarn receiving surface 52' of the associated sinker and a terry pile loop $B_t$ of the first terry body yarn B extending over the upper raised yarn receiving surface 52' of the associated sinker 52. Additionally, the terry pile loop $T_t$ shown in FIG. 9 also extends across the upper raised yarn receiving surface 52'' of the sinker 52 of FIG. 10 inasmuch as the second terry body yarn T was not received and knitted by the needle 250A. As will be understood, during each revolution of the machine, the needles of Group II operate in identical manner to the needles 150A,250A, with the sinkers 52 remaining active in the same manner as the sinkers associated with such needles, so that the first terry body yarn B and the ground yarn G continue to be knitted by the needles of Group II in plated needle loops of the two yarns B,G, sinker loops of the ground yarn G, and terry loops of the terry body yarn B. However, the second terry body yarn T is not received or knitted by any of the needles of Group II or their associated sinkers.

Following the completion of the last revolution of the knitting machine in the formation of the leg portion 14, the needles 50 and the sinkers 52 become operable to begin the formation of the high splice and front ankle regions 26,42 of the foot portion 12. In the knitting of these areas, the needles of Group I previously designated for forming the dual terry front shin area 34 of the leg portion 14 are now designated for forming the single jersey front ankle area 42, while the needles of Group II previously designated for forming the single terry rear calf area 36 of the leg portion 14 are now designated for forming the high splice region 26 in the same dual terry construction as the front shin area 34. The sinkers 52 associated with the needles of Group I are deactivated to remain radially outwardly withdrawn for the knitting of the front ankle region 42, while the sinkers 52 associated with the needles of Group II remain active for the knitting of the high splice region 26. This is accomplished by utilizing short butt-type sinkers in the sinker slots of the sinker ring associated with the needles of Group I and long butt-type sinkers in the other sinker ring slots, and operating the machine control arrangement to manipulate the sinker cam to its aforesaid intermediate position following the completion of the knitting of the leg portion 14 so that the sinker cam operates only on the long butt sinkers. All of the yarns B,T,G continue to be fed at the same respective feeding levels as in the knitting of the leg portion 14.

Throughout the revolutions of the knitting machine during the formation of the high splice region 26 and the corresponding circumferentially adjacent part of the front ankle region 42, alternate and intermediate needles of Group II are alternately manipulated to the extended and basic yarn receiving positions in repetitive cycles of four machine revolutions each identically as above-described for the needles of Group I during the knitting of the leg portion 14, thereby to form the high splice region 26 of the same double terry knitted construction as the front shin area 34 of the leg portion 14.

During each such revolution in the knitting of the high splice region 26, the needles of Group I are all raised to the basic yarn receiving position to receive only the ground and first terry body yarns and to knit plated needle loops thereof. Since the sinkers associated with the needles of Group I are inactive throughout these machine revolutions, the first terry body yarn B is not formed in terry loops over the upper raised yarn receiving surfaces of such sinkers but instead is only formed over the basic yarn receiving surfaces of the associated sinkers in sinker loops in plated relationship with the sinker loops of the ground yarn G. In this manner, the front ankle region 26 is formed of a single jersey stitch construction incorporating only the ground and first terry body yarns G,B.

Upon the completion of the last revolution of the knitting machine for the formation of the high splice region 26, the control arrangement of the knitting machine switches the needle cylinder and sinker ring to reciprocal operation to render only a portion of the needles of Group II and the associated sinkers to be active for knitting operation in conventional reciprocal manner to knit the contoured heel pocket region 24 of a single terry fabric construction.

Following the completion of the last reciprocal revolution of the knitting machine for forming the heel pocket region 24, the control arrangement of the machine restarts its rotational operation to continue operation identically as described above for the high splice region 26 and the corresponding portion of the front ankle region 42, with the needles of Group I operative to continue the formation of the front ankle region 42 in a single terry stitch construction of the ground and first terry body yarns G,B and with the needles of Group II operative to begin the formation of the sole splice region 28 of the same double terry construction as the high splice region 26 of the foot portion 12 and the front shin area 34 of the leg portion 14. Such operation continues for a plurality of revolutions of the knitting machine to complete the formation of the front ankle region 42.

Following the completion of the last revolution of the knitting machine in forming the front ankle region 42, the sinkers associated with the needles of Group I are reactivated, with operation of the machine continuing otherwise without change from the immediately previous operation in knitting the front ankle region 42 and the sole splice region 28. The needles of Group I and their associated sinkers therefore begin the formation of the forward instep region 44 in a single terry fabric construction of the ground and first terry body yarns G,B identically to the single terry rear calf area 36 of the leg portion 14, with the needles of Group II and their associated sinkers continuing the formation of the same dual terry fabric construction as the sole splice region 28. The knitting machine continues operation in this manner for a sufficient plurality of revolutions to form the remainder of the lower sole and upper instep areas 18,20 of the foot portion 12.

Following the completion of the last revolution of the knitting machine in forming the lower sole and upper instep areas 18,20, the control arrangement of the knitting machine again switches the machine to reciprocal operation to form the contoured toe pocket region 22 of a single terry construction incorporating the ground and single terry body yarns G,B, in the same manner as described above for the knitting of the heel pocket region 24. Following the completion of the toe pocket region 22, the machine is returned to rotational operation, the sinkers are deactivated and the needles are raised to their basic yarn receiving positions for several further revolutions of the knitting machine to knit several complete single jersey fabric courses to provide a short fabric end selvage for use in sewing the toe pocket region 22 closed in a subsequent sewing operation, as is conventional.

It is a particular feature of the above-described method of the present invention that each yarn feeding finger 54 is stationarily set and remains in its respective yarn feeding position throughout the entire operation of knitting the sock 10 and, during each revolution of the knitting machine for knitting any of the double terry cushion areas, the second terry yarn T is automatically cut at the completion of feeding of the yarn to the particular group of needles to which the terry yarn T is fed without manipulating the terry yarn feeding finger 54T to a non-feeding position. For this purpose, the knitting machine is of the type having a dial plate 62 rotationally mounted coaxially with the needle cylinder at the upper end thereof for synchronous rotation therewith (see FIG. 9). The dial plate 62 is provided with an annular saw-tooth cutting edge 64 with a presser bar 66 stationarily disposed in close adjacency to the cutting edge 64 at a slight arcuate spacing following the knitting station 60. As previously described, during the formation of each double terry cushion area at the front shin area 34 of the leg portion 14 and the high splice, low splice, arch and ball regions 26,28,30,32 of the foot portion 12, the needles of only one of the Groups I and II are operable at the extended yarn receiving position to receive and knit the second terry yarn T while all of the needles of the other group are operable only at the basic yarn receiving position and thereby miss the second terry body yarn T. Accordingly, during each revolution of the knitting machine in the formation of these double terry cushion areas, the last extended position needle of the designated double terry needle group in advance of the non-designated needle group operates to carry the second terry yarn T as such last extended position needle passes the knitting station 60 and continues movement with the cylinder rotation to and past the location of the presser bar 66 to automatically direct the second terry body yarn T between the presser bar 66 and the saw tooth edge 64 of the dial plate 62, thereby cutting the second terry body yarn T during each cylinder revolution.

The present method thus provides a number of unique terry knitting capabilities over conventional terry knitting methods. First, the present method enables the formation of two sets of terry loops of different shapes and sizes, namely, the terry loops $B_5,T_t$ of the two terry yarns B,T, which provide a dual terry cushion construction having unique wear characteristics. Specifically, the second set of terry loops $T_t$ of the terry body yarn T extend between alternate wales of the dual terry cushion area to span the intermediate wales as well as the sinker loop spacings between the wales, in contrast to the first set of terry loops $B_t$ of the first terry body yarn B which are of conventional construction extending only across the sinker spacings between adjacent wales. As a result, the second set of terry loops $T_t$ are staggered walewise with respect to the first set of terry loops $B_t$ and, owing to the alternation of the needles operative for knitting the second terry yarn T, the terry loops $T_t$ are also staggered walewise with respect to one another between the various courses of the cushion area. Accordingly, the two sets of terry loops $B_t$,$T_t$ provide upstanding support for one another both coursewise and walewise to resist flattening of the terry loops $B_t$,$T_t$ and to maintain the elongation of the terry loops $B_t$,$T_t$ for better cushioning support for the wearer's foot and leg and better action in wicking moisture away from the wearer's foot. In contrast, in conventional single terry or conventional double terry fabric constructions, all terry loops are of the same size and shape and are identically aligned walewise to one another, whereby the terry loops in such conventional fabrics tend to flatten easily, deleteriously affecting the ability of the terry loops to provide cushioning and moisture absorption as desired. Moreover, the knitting method and knitted cushion area construction of the present invention achieve these advantages while utilizing less yarn of the second terry body yarn than in conventional double terry constructions and methods, due to the feeding of the second terry body yarn to only every other needle during each revolution.

As will be understood, the present method enables considerable selection and variation in the formation of the terry loops $T_t$ of the second terry yarn T from that as described above. For instance, a double terry cushion area may be knit about the entire circumference of an athletic sock as desired. Furthermore, during any given revolution of the knitting machine, substantially any combination and spacing of needles may be selected for raising to the extended position for receiving and knitting the second terry yarn. For example, every third needle, rather than every alternate needle, of the needles selected for knitting a dual terry cushion area may be raised to the extended yarn receiving position for knitting the terry yarn T. As desired, the needles selected for knitting the terry yarn T may be alternated or otherwise changed every machine revolution, rather than knitting courses in pairs as above-described. The selected variation of needles active to knit the second terry yarn T also provides the capability for producing a variety of different visual designs in the present dual terry cushion area through the use of differently colored terry yarns. As mentioned, in the needle loops incorporating each of the terry and ground yarns B,T,G, the needle loop of the second terry yarn T appears on the outside face of the knitted fabric, while in all other needle loops of the fabric incorporating only the second terry and ground yarns B,G, the needle loops of the second terry yarn B appears on the outside face of the fabric. Thus, by utilizing a two course repeat of alternate and intermediate needles as above-described a knit a dual terry cushion area of the type of the present invention, a houndstooth-like checkered pattern may be produced on the outside face of the fabric when two differently colored terry yarns are used, as is illustrated in FIG. 1. Of course, those persons skilled in the art will readily recognize that other design variations may also be produced.

The method of the present invention further enables the formation of selected double terry cushion areas coursewise adjacent single terry or non-terry areas without the use of a so-called "chopping" feed finger of the type described in the aforementioned U.S. Pat. Nos. 3,793,851 and 4,277,959. Conventionally, such a chopping feed finger is utilized for the formation of conventional double terry fabric areas coursewise adjacent other fabric areas by repetitively moving the chopping finger into and out of yarn feeding position during each knitting machine revolution through the double terry area to achieve placement of the second terry yarn on only selected successive needles designated to knit the double terry area. According to the present invention, double terry areas are selectively knit by needle manipulation rather than feed finger manipulation, whereby the yarn feed finger designated for feeding the second terry yarn may be stationarily set and left at its desired yarn feeding position throughout the entire sock knitting operation. While the conventional use of a chopping feed finger is highly subject to problems of proper synchronization of the finger movement with the rotation of the needle cylinder and is particularly prone to missed needles and stitches, no such problems are suffered with the present method. As a result, the present method may be carried out at greater speeds than methods utilizing a chopping feed finger with correspondingly greater rates of sock or other knitted fabric production. Furthermore, as those persons skilled in the art will understand, the staggered arrangement of the second set of terry loops provided by the present invention is impossible to produce utilizing the conventional chopping finger method since it is impossible to move the chopping finger into and out of feeding operation on a repetitive basis with sufficient speed and accuracy to selectively feed a yarn to only selected spaced needles during any single revolution of the knitting machine.

The varied mock rib constructions in the front shin and rear calf areas of the elastic cuff portion of the present sock provide further advantages by enabling the calf area a sufficient degree of stretchability to accommodate and conform to a variety of calf sizes and shapes, without sacrificing overall snugness over the entire circumference of the elastic cuff portion to resist slippage of the cuff and leg portions on the wearer's leg. The single jersey front ankle panel additionally resists wrinkling and bunching of the sock in the front ankle region and therefore provides better conformity to the instep of the wearer's foot in such region for greater comfort in wearing.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. In a circularly-knitted article formed of yarn knitted in circumferential courses and axial wales, the improvement comprising a cushion area occupying a plurality of successive courses and a plurality of successive wales therein, said cushion area having a first terry yarn knitted in substantially every said successive course in jersey stitches in substantially every said successive wale and in terry pile loops intermediate said successive wales, and a second terry yarn knitted in first selected ones of said successive courses in jersey stitches in selected spaced ones of said successive wales and in terry pile loops spanning the non-selected successive wales therebetween, said terry loops of said first and second terry yarns being staggered walewise with respect to one another to provide upstanding support for one another to maintain upstanding extension and inhibit flattening of said terry loops of said first and second yarns during use of said knitted article.

2. The improvement in a circularly knitted article according to claim 1 and characterized further in that said second terry yarn is knitted in other selected ones of said successive courses in jersey stitches in other selected spaced ones of said successive wales and in terry pile loops spanning the non-selected successive wales therebetween.

3. The improvement in a circularly-knitted article according to claim 1 and characterized further by a ground yarn knitted in said substantially every said successive course in jersey stitches in said substantially every said successive wale in plated relationship with said first terry yarn in said substantially every said successive course and with said second terry yarn in said first selected courses in said selected spaced successive wales thereof.

4. The improvement in a circularly-knitted article according to claim 1 and characterized further in that said terry loops of said second terry yarn have a greater upstanding height than said terry loops of said first terry yarn to provide a dual thickness of said terry loops of said first and second terry yarns.

5. The improvement in a circularly-knitted article according to claim 2 and characterized further in that said first selected successive courses of said second terry yarn comprise alternating course groups each of at least one said successive course and said other selected successive courses of said said second terry yarn comprise the other said successive courses intermediate said alternating courses.

6. The improvement in a circularly-knitted article according to claim 5 and characterized further in that said selected successive wales of said first selected successive courses comprise alternating ones of said wales and said non-selected successive wales of said first selected successive courses comprise the intermediate successive wales, and said selected successive wales of said other selected successive courses comprise said intermediate successive wales and said non-selected successive wales of said other selected successive courses comprise said alternating wales.

7. The improvement in a circularly-knitted article according to claim 1 and characterized further in that said knitted article comprises an athletic sock including a foot portion having a lower sole area, said cushion area occupying at least a region of said lower sole area for cushioning of the sole of the wearer's foot.

8. The improvement in a circularly-knitted article according to claim 7 and characterized further in that said athletic sock further includes a leg portion and characterized further by another said cushion area occupying at least an area of said leg portion.

9. The improvement in a circularly-knitted article according to claim 1 and characterized further in that said knitted article comprises an athletic sock including a foot portion having a front ankle region, said front ankle region being of a plain non-terry knitted construction, said cushion area occupying at least another region of said foot portion, and substantially any remaining regions of said foot portion being of another terry knitted construction, said non-terry front ankle region being adapted to conform to the front of the wearer's ankle without wrinkling or folding for promoting the comfort of the wearer.

10. The improvement in a circularly-knitted article according to claim 1 and characterized further in that said knitted article comprises an athletic sock including a foot portion and a leg portion with an elastic cuff, said cushion area occupying at least a selected portion of said foot portion, said elastic cuff being of a mock rib construction and having a front shin area of a relatively more frequent rib repeat and a rear calf area of a relatively less frequent rib repeat to provide said rear calf area with a greater degree of coursewise stretchability than said front shin area to enable said rear calf area to conform to the shape and size of the wearer's calf and to prevent slippage of said leg portion on the wearer's leg.

11. In a circularly-knitted athletic sock formed of yarn knitted in circumferential courses and axial wales, the improvement comprising a dual thickness terry-loop cushion area characterized by an ability to inhibit flattening of the terry loops thereof and to provide enhanced cushioning and comfort of the wearer's foot during athletic and like activity, said cushion area occupying a plurality of successive courses and a plurality of successive wales therein, said cushion area having a first terry yarn knitted in substantially every said successive course in jersey stitches in substantially every said successive wale and in terry pile loops intermediate said successive wales, and a second terry yarn knitted in alternating course groups each of at least one said successive course in jersey stitches in alternating ones of said successive wales and in terry pile loops spanning the intermediate successive wales and knitted in intermediate course groups each of at least one said successive course in jersey stitches in said intermediate successive wales and in terry pile loops spanning said alternating successive wales, said terry loops of said second terry yarn being more elongated than said terry loops of said first terry yarn to provide a dual thickness of said terry loops of said first and second terry yarns, said terry loops of said second terry yarn in said alternate and intermediate courses being staggered walewise with respect to one another and to said terry loops of said first terry yarn, said terry loops of said first and second yarns providing upstanding support for one another to maintain upstanding extension and inhibit flattening of said terry loops of said first and second yarns during wearing of said sock.

12. The improvement in a circularly-knitted athletic sock according to claim 11 and characterized further by a ground yarn knitted in every said successive course in jersey stitches in every said successive wale in plated relationship with said first and second terry yarns.

13. The improvement in a circularly-knitted athletic sock according to claim 12 and characterized further in that said sock comprises a foot portion including a lower sole area, said cushion area occupying at least a region of said lower sole area for cushioning of the sole area of the wearer's foot.

14. The improvement in a circularly-knitted athletic sock according to claim 13 and characterized further in that said athletic sock further includes a leg portion and characterized further by another said cushion area occupying at least an area of said leg portion.

15. The improvement in a circularly-knitted athletic sock according to claim 12 and characterized further in that said sock comprises a foot portion having a front ankle region, said front ankle region being of a plain non-terry knitted construction, said cushion area occupying at least another region of said foot portion, and substantially any remaining regions of said foot portion being of another terry knitted construction, said non-terry front ankle region being adapted to conform to the front of the wearer's ankle without wrinkling or folding for promoting the comfort of the wearer.

16. The improvement in a circularly-knitted athletic sock according to claim 12 and characterized further in that said sock comprises a foot portion and a leg portion with an elastic cuff, said cushion area occupying at least a selected portion of said foot portion, said elastic cuff being of a mock rib construction and having a front shin area of a relatively more frequent rib repeat and a rear calf area of a relatively less frequent rib repeat to provide said rear calf area with a greater degree of coursewise stretchability than said front shin area to enable said rear calf area to conform to the shape and size of the wearer's calf and to prevent slippage of said leg portion on the wearer's leg.

17. In a circularly-knitted athletic sock having a foot portion and a leg portion, the improvement comprising an annular elastic cuff portion on said leg portion of a mock-rib construction and having a front shin area and a rear calf area at opposite circumferential sides of said cuff portion, said front shin area being of a relatively more frequent rib repeat and said rear calf area being of a relatively less frequent rib repeat to provide said rear calf area with a greater degree of coursewise stretchability than said front shin area to enable said rear calf area to conform to the shape and size of the wearer's calf and to prevent slippage of said elastic cuff portion on the wearer's leg.

18. The improvement in a circularly-knitted athletic sock according to claim 17 and characterized further in that said cuff includes a yarn knitted in a single-jersey stitch construction in circumferential courses and axial wales of needle loops of said yarn, a first group of successive wales forming said front shin area and a second group of successive wales at the opposite circumferential side of said cuff forming said rear calf area, and an elastic yarn laid in each course in said needle loops of selected spaced wales and floating across said needle loops of non-selected wales, said selected wales in said first wale group being more frequently spaced than said selected wales in said second wale group.

19. The improvement in a circularly-knit athletic sock according to claim 18 and characterized further in that each of said first and second group of wales includes approximately one-half of the wales of said cuff.

20. The improvement in a circularly-knit athletic sock according to claim 19 and characterized further in that said selected wales in said first wale group are alternate wales therein and said selected wales in said second wale group include no more frequent than every third wale therein.

* * * * *

UNITED STATES PATENT AND TRADEMARK OFFICE

CERTIFICATE OF CORRECTION

PATENT NO. : 4,732,015

DATED : March 22, 1988

INVENTOR(S) : Walter W. Abrams, Roger D. Good

It is certified that error appears in the above-identified patent and that said Letters Patent is hereby corrected as shown below:

Abstract, 2nd column, line 21: Delete "stationariy" and insert -- stationarily --.

Column 1, line 24: Delete "or" and insert -- on --.

Column 5, line 49: Delete "the" (first occurrence) and insert -- and --.

Column 6, line 25: After "is" add -- a --.

Column 7, line 10: Delete "4" and insert -- 24 --.

Column 8, line 45: After "namely," insert -- a --.

Column 9, line 58: After "terry" (first occurrence) add -- body --.

Column 13, line 52: Delete "way" and insert -- may --.

Column 15, line 1: Delete "The" and insert -- This --.

Column 15, line 19: After "60," add -- each --.

Column 18, line 53: Delete "$B_5$" and insert -- $B_t$--.

Signed and Sealed this

Twentieth Day of March, 1990

*Attest:*

JEFFREY M. SAMUELS

*Attesting Officer*

*Acting Commissioner of Patents and Trademarks*